United States Patent [19]

Libby et al.

[11] Patent Number: 4,897,294

[45] Date of Patent: Jan. 30, 1990

[54] INSULATING MATERIAL CONTAINING DELAMINATED VERMICULITE

[75] Inventors: Stephen C. Libby, Bowling Green, Ohio; G. Edward Graddy, Jr., Murrysville, Pa.

[73] Assignee: Aluminum Company of America, Pittsburgh, Pa.

[21] Appl. No.: 242,499

[22] Filed: Sep. 12, 1988

Related U.S. Application Data

[63] Continuation-in-part of Ser. No. 123,336, Nov. 19, 1987, Pat. No. 4,773,470.

[51] Int. Cl.[4] ..... B22C 1/18; B22C 9/12; B22D 7/10; B28B 7/36; B29C 33/38

[52] U.S. Cl. ..... 428/34.1; 106/38.22; 106/38.35; 106/120; 164/123; 164/138; 164/487; 164/529; 264/225; 264/234; 264/344; 264/345; 428/469; 428/471; 428/703

[58] Field of Search ..... 164/123, 138, 418, 487, 164/529; 106/120, 38.35, 38.22; 428/703, 34.1; 264/225, 234, 344, 345

[56] References Cited

U.S. PATENT DOCUMENTS

| | | | |
|---|---|---|---|
| 3,212,142 | 10/1965 | Moritz | 22/57.2 |
| 4,101,335 | 7/1978 | Barrable | 106/99 |
| 4,132,555 | 1/1979 | Barrable | 106/90 |
| 4,773,470 | 9/1988 | Libby et al. | 164/487 |

*Primary Examiner*—James C. Cannon
*Attorney, Agent, or Firm*—Glenn E. Klepac

[57] ABSTRACT

An asbestos-free insulating material suitable for use as a header in molten metal casting. The material is made from a dry mixture comprising lime, siliceous component, delaminated vermiculite or spodumene or lithium aluminate or mixtures thereof, and optionally, wollastonite and organic fiber. The dry mixture is mixed with water to form a slurry, shaped, heated in the presence of steam, and dried to remove free water.

10 Claims, 1 Drawing Sheet

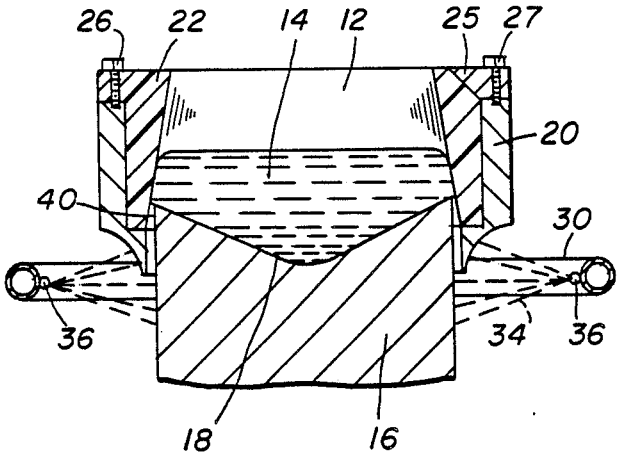
26
22
14
12
25
27
20
40
30
36
34
36
18
16

INSULATING MATERIAL CONTAINING DELAMINATED VERMICULITE

CROSS REFERENCE TO RELATED PATENT APPLICATION

This application is a continuation-in-part of U.S. Ser. No. 123,336 filed Nov. 19, 1987 and entitled "Casting Aluminum Alloys with a Mold Header Comprising Delaminated Vermiculite.", now U.S. Pat. No. 4,773,470.

FIELD OF THE INVENTION

The present invention relates to an insulating material that is resistant to attack by molten metal. More particularly, the invention is an insulating material containing delaminated vermiculite or spodumene or lithium aluminate or mixtures thereof.

BACKGROUND OF THE INVENTION

Insulating materials resistant to attack by molten metals, including aluminum alloys, are known to the prior art. For example, Moritz U.S. Pat. No. 3,212,142 discloses a process and apparatus for continuous aluminum casting. The apparatus includes a mold having an outer metal shell lined with an annular header or liner of insulating material. The insulating header is made from a composition wherein asbestos fibers are distributed in an inorganic binder.

Asbestos-containing insulating materials have performed satisfactorily in the aluminum industry for several years. However, it is now necessary to discontinue usage of asbestos-containing materials because of health concerns. Accordingly, there is presently a need for asbestos-free insulating materials suitable for use as headers in continuous aluminum alloy casting.

Barrable U.S. Pat. No. 4,101,335 claims a fire-resistant asbestos-free building board comprising mica or a mixture of mica and standard vermiculite distributed in a calcium silicate binder. Barrable U.S. Pat. No. 4,132,555 claims an asbestos-free building board comprising standard vermiculite distributed in a water-soluble binder containing organic reinforcing fibers. Neither of the Barrable patents suggests utilization of delaminated vermiculite or spodumene or lithium aluminate as an asbestos substitute.

A principal objective of the present invention is to provide an insulating material suitable for use as a header in continuous molten metal casting.

It is a related objective of the invention to provide an insulating material of the type described wherein asbestos is replaced by delaminated vermiculite, spodumene, lithium aluminate, or mixtures thereof.

Another objective of the invention is to provide an insulating material that is resistant to attack by molten metal, demonstrates low absorption of oils used as parting compositions, and has satisfactory strength.

Additional objectives and advantages of the invention will become readily apparent to persons skilled in the art from the following detailed description of our invention.

BRIEF DESCRIPTION OF THE DRAWING

The sole FIGURE is a cross-sectional view of a continuous casting apparatus for performing aluminum alloy casting utilizing the insulating material of the present invention as a header.

SUMMARY OF THE INVENTION

In accordance with the present invention, there is provided an insulating material comprising about 15–40 wt % lime, about 15–40 wt % siliceous component, about 10–70 wt % delaminated vermiculite or spodumene or lithium aluminate or mixtures thereof, about 0–55 wt % wollastonite, and about 0–10 wt % organic fiber. The composition preferably comprises about 15–35 wt % lime, about 15–35 wt % siliceous component, about 12–25 wt % delaminated vermiculite, about 15–50 wt % wollastonite, and about 1–10 wt % organic fiber.

A more preferred composition comprises about 15–25 wt % lime, about 15–25 wt % siliceous component, about 12–20 wt % delaminated vermiculite, about 30–50 wt % wollastonite, and about 1–8 wt % organic fiber. The material is preferably substantially asbestos-free.

The material is made by mixing together a dry mixture comprising lime, the siliceous component, delaminated vermiculite, wollastonite, and organic fiber with water to form an aqueous slurry; molding the aqueous slurry into a wet shape; expelling water from the wet shape; heating the wet shape in the presence of steam; and drying the wet shape to remove water. The step of heating in the presence of steam is preferably performed above 100° C. at superatmospheric pressure. Lime comprises about 15–40 wt % of the dry mixture, preferably about 15–35 wt % and more preferably about 15–25 wt %. The lime may be any suitable hydrated lime or quicklime.

The siliceous component may be any of several sources of substantially pure oxides of silicon. The sources include silica, diatomaceous earth, and similar materials. The siliceous component comprises about 15–40 wt % of the dry mixture, preferably about 15–35 wt % and more preferably about 15–25 wt %.

As used herein, the term "delaminated vermiculite" refers to vermiculite that is delaminated by heating or by any of several known chemical delamination processes. Chemically delaminated vermiculite, made by first swelling layered material with aqueous salts and thereafter mechanically shearing the swollen granules, is particularly preferred. After production, the suspension of chemically delaminated mineral is subjected to a wet classification treatment in which larger particles of the mineral are removed. For use in making insulating material in accordance with the present invention, the suspension is preferably wet classified to an average particle size of less than about 50 microns. Delaminated vermiculite comprises about 10–70 wt % of the dry mixture, preferably about 12–25 wt % and more preferably about 12–20 wt %.

Wollastonite is a crystalline form of anhydrous calcium silicate. It is preferable to use wollastonite having sufficiently small particle size that approximately 50 wt % of its particles pass a standard U.S. 200 mesh screen. The wollastonite particles preferably have an aspect ratio of greater than about 4. The mixture comprises about 0–55 wt % wollastonite, preferably about 15–50 wt % and more preferably about 30–50 wt %.

The dry mixture of ingredients also contains up to about 10 wt % of an organic fiber, preferably about 1–10 wt % and more preferably about 1–8 wt %. The organic fiber may be wood fiber, polyester or other synthetic fiber, cotton or other natural fibers. Wood fiber is particularly preferred. The purpose of the organic fiber is to provide "green strength" to the insulating material prior to being cured by steam and also to provide stress distribution during drying and curing.

Various other inorganic substances may be added to the dry mixture if desired. Such additives may include glass fibers, spodumene (a mineral containing lithium aluminum silicate), lithium aluminate, and mineral wool.

The insulating material of the invention is particularly suitable for headers used in continuous casting of light metals, especially aluminum and magnesium alloys. With modification, the material may also be employed for casting steel, iron, copper, titanium, zirconium, niobium, calcium, lithium, silicon, and various alloys thereof.

DETAILED DESCRIPTION OF A PREFERRED EMBODIMENT

In a preferred embodiment, a dry mixture comprising approximately 23 wt % hydrated lime, 21 wt % silica, 40 wt % wollastonite, 14 wt % delaminated vermiculite, and 2 wt % wood fiber was slurried in about 4–5 parts water per part of dry mixture. This slurry was then molded in a pressure mold to form a wet shape. The wet shape was then cured by autoclaving in saturated steam for several hours at approximately 170° C. The cured material was dried at approximately 110° C. to reduce moisture content. The cured and dried material has a calcium silicate crystalline matrix that is predominantly tobermorite.

The material formed as described above was found satisfactory for cutting into shapes which may be used as headers in the continuous direct chill casting of aluminum alloys including aluminum-lithium alloys. Such alloys generally contain at least about 1.0 wt % lithium. Aluminum-lithium alloys may contain more than about 1.5 wt % and even more than about 2 wt % lithium in some cases. For example, aluminum-lithium alloy 2091 contains about 1.8–2.5 wt % Cu; about 1.7–2.3 wt % Li; about 1.1–1.9 wt % Mg; about 0.08–0.16 wt % Zr; 0.20 wt % max Si; 0.30 wt % max Fe; 0.10 wt % max Mn, Cr, and Ti; 0.25 wt % max Zn, and 0.15 wt % max other impurities.

There is shown in the Figure a continuous casting apparatus 10 for direct chill casting of an aluminum-lithium alloy. Molten metal at a temperature of about 716° C. (1320° F.) is introduced into an interior portion of chamber 12 of the apparatus 10. The metal initially forms a molten pool 14 above a solid ingot or shell 16. The pool 14 and ingot 16 are separated by a solidus line 18. The aluminum-lithum alloy has a solidus temperature of about 593° C. (1100° F.).

The apparatus 10 also includes a mold comprising an outer metal container 20 and an inner header or liner 22. The header 22 contacts the molten metal pool 14 and insulates the container 20 from pool 14. The header 22 is kept in place by a clamp or retaining clamp 25 overlying the metal container 20 and an outer portion of the header 22. The clamp 45 is fastened to the container 20 by metal bolts 26, 27 or other preferred attaching means. A spray bar 30 adjacent the mold contains a coolant 32 for lowering temperature of the ingot 16 and lower portions of the metal container 20. The direct chill coolant emerges as a spray 34 from opening 36 in the spray bar 30. For most aluminum alloys, the preferred coolant is water. However, ethylene glycol is utilized for cooling alloys containing more than about 1.5 wt % lithium in order to reduce the risk of explosions.

A parting composition is applied to outer surface portions 40 of the ingot 16 as it forms in the mold. The parting composition is preferably an alpha-olefin oligomer which reduces friction between the mold and such surface portions 40. In the absence of the lubrication, the continuously forming ingot would tear on the mold surface. Tears are defects on the ingot surface 40, and they also facilitate bleedouts of molten metal which may come into direct contact with the coolant 34. It is particularly desirable to avoid such bleedouts in casting aluminum-lithium alloys because of the danger posed by explosion.

Additional details of continuous direct aluminum-lithium casting processes are found in Laemmle et al U.S. Pat. No. 4,602,670; Tsai et al U.S. Pat. No. 4,607,679; and Jacoby et al U.S. Pat. No. 4,628,985. The disclosures of such patents are incorporated herein by reference to the extent consistent with the present invention.

The foregoing detailed description of our invention has been made with reference to a preferred embodiment thereof. From such description, one skilled in the art can easily ascertain the essential characteristics of this invention, and without departing from the spirit or scope thereof make various changes and modifications to adapt it for various usages and conditions.

What is claimed:

1. An insulating material suitable for use as a header in continuous molten metal casting and comprising about:

(a) 15–40 wt % lime;
(b) 15–40 wt % siliceous component;
(c) 10–70 wt % delaminated vermiculite or spodumene or lithium aluminate or mixtures thereof;
(d) 0–55 wt % wollastonite; and
(e) 0–10 wt % organic fiber.

2. An insulating material as claimed in claim 1 comprising about:

(a) 15–35 wt % lime;
(b) 15–35 wt % siliceous component;
(c) 12–25 wt % delaminated vermiculite;
(d) 15–50 wt % wollastonite; and
(e) 1–10 wt % organic fiber.

3. An insulating material as claimed in claim 1 comprising about:

(a) 15–25 wt % lime;
(b) 15–25 wt % siliceous component;
(c) 12–20 wt % delaminated vermiculite;
(d) 30–50 wt % wollastonite; and
(e) 1–8 wt % organic fiber.

4. An insulating material as claimed in claim 1 wherein said material is substantially asbestos-free.

5. An insulating material as claimed in claim 1 wherein said material is made by mixing lime, the siliceous component, delaminated vermiculite, wollastonite, and organic fiber with water to form an aqueous slurry; molding the aqueous slurry into a wet shape; expelling water from the wet shape; heating the wet shape in the presence of steam; and drying the wet shape to remove free water.

6. An insulating material as claimed in claim 5 wherein said material has a matrix comprising calcium silicate hydrate.

7. An insulating material as claimed in claim 5 wherein said material has a matrix comprising predominantly tobermorite.

8. An asbestos-free insulating material consisting essentially of about:

(a) 15–40 wt % lime;

(b) 15–40 wt % silica;

(c) 10–70 wt % delaminated vermiculite or spodumene or lithium aluminate or mixtures thereof;

(d) 0–55 wt % wollastonite; and (e) 1–8 wt % organic fiber.

9. An insulating material as claimed in claim 8 wherein said insulating material is made by mixing lime, silica, delaminated vermiculite, wollastonite, and organic fiber with water to form an aqueous slurry; molding the aqueous slurry into a wet shape; expelling water from the wet shape; heating the wet shape above 100° C. in the presence of steam; and drying the wet shape to remove free water.

10. An asbestos-free insulation material made by the steps of:

(a) mixing a dry mixture comprising about 15–25 wt % lime, about 15–25 wt % silica, about 12–20 wt % delaminated vermiculite, about 30–50 wt % wollastonite, and about 1–8 wt % organic fiber with water to form an aqueous slurry;

(b) molding the aqueous slurry into a wet shape;

(c) expelling water from the wet shape;

(d) heating the wet shape above about 100° C. in the presence of steam; and (e) drying the wet shape to remove free water.

* * * * *